US005103746A

United States Patent [19]

Dibben et al.

[11] Patent Number: 5,103,746

[45] Date of Patent: Apr. 14, 1992

[54] EMBROIDERY

[76] Inventors: Martina Dibben; Eva-Maria King, both of 30 Ibstone Avenue, Bradwell Common, Milton Keynes, Buckinghamshire, MK13 8EA; Robert G. Millar, "Wares Warren", Stratford Road, Wootton Wawen, Nr. Henley-in-Arden, Warwickshire, B95 6DG, all of England

[21] Appl. No.: 428,165

[22] Filed: Oct. 27, 1989

Related U.S. Application Data

[63] Continuation-in-part of Ser. No. 174,004, Mar. 29, 1988.

[30] Foreign Application Priority Data

Mar. 30, 1987 [GB] United Kingdom ..... 8707540

[51] Int. Cl.[5] ..... D05C 15/06

[52] U.S. Cl. ..... 112/80.03; 112/80.05; 112/169; 112/266.1

[58] Field of Search ..... 112/439, 80.03, 80.05, 112/169, 266.1, 266.2, 222

[56] References Cited

U.S. PATENT DOCUMENTS

| | | | |
|---|---|---|---|
| 507,234 | 10/1893 | Merrow | 112/266.1 |
| 2,354,215 | 7/1944 | Lutz | 112/266.1 |
| 2,369,470 | 2/1945 | Langa | 112/266.1 |
| 2,610,598 | 9/1952 | Midas | 112/80.05 |

FOREIGN PATENT DOCUMENTS

| | | | |
|---|---|---|---|
| 386639 | 4/1908 | France | 112/266.1 |
| 433400 | 8/1935 | United Kingdom | 112/80.05 |

*Primary Examiner*—Werner H. Schroeder
*Assistant Examiner*—Paul C. Lewis
*Attorney, Agent, or Firm*—Ross, Ross & Flavin

[57] ABSTRACT

A method of embroidery on a fabric and an embroidery tool enable the production in a simple manner of decorative effect on knitted or other garments. The tool has a tubular needle portion with a handle at one end and a closed curved point at the other. The handle has an entry aperture for continuous work material such as yarn, which passes from the entry aperture through a smooth duct in the tool to an exit aperture formed on the convex surfaces of the curved end adjacent the point. The method of embroidery using the tool comprises the initial steps of passing the point, carrying a loop of yarn, through the fabric from the front to the rear and back again at a different location, the handle remaining at the front, and the repeated steps of retaining the loop of yarn at the front while withdrawing the point from the fabric, and then passing the point, carrying a fresh loop of yarn, through the previous loop, and then through the fabric as before.

6 Claims, 2 Drawing Sheets

EMBROIDERY

This is a continuation-in-part of application Ser. No. 174 004 filed Mar. 29th, 1988.

This invention relates to a method of embroidery for creating a decorative effect on a fabric, and to an embroidery tool.

It is a particular object of the invention to enable the production in a simple manner of decorative effects on knitted or other garments.

Various methods of and tools for creating decorative effects are known, from traditional embroidery using an embroidery needle, to surface crochet, in which a standard crochet hook is used to work crochet stitches onto the fabric, the hook being inserted to catch a portion of the fabric, to which the stitches are anchored. These known methods however require a considerable amount of skill on the part of the user.

According to a first aspect of the invention, a method of creating a decorative effect on a fabric comprises the initial steps of passing a loop of continuous work material through the fabric from the front side to the rear side thereof, passing the loop through the fabric at a spaced location from the rear side to the front side; and the repeated steps of passing a fresh loop of the same continuous work material through the previous loop, passing the fresh loop through the fabric from the front side to the rear side thereof, and passing the fresh loop through the fabric at a next spaced location from the rear side to the front side thereof.

The method may include the step of twisting a loop passed through the fabric from the front side to the rear side and back to the front side, before a fresh loop is passed through it.

The method may also include the step of forming a series of loops passed through the fabric from the front side to the rear side and back to the front side, and passing a fresh loop through all the loops in the series.

The method may further include the step of winding a further length of work material round a loop passed from the front side to the rear side and back to the front side again, before a fresh loop is passed through it.

The method may also include the steps of passing a fresh loop through a previous loop, but not through the fabric, and performing the initial steps with a subsequent fresh loop.

The method is preferably performed by using an elongate tool having a pointed leading end provided with an aperture through which the work material is threaded, and a tail end, the method then comprising the initial steps of passing the pointed end of the tool, carrying a loop of material, through the fabric from the front side to the rear side; the tail end of the tool remaining at the front side, passing the pointed end, carrying the loop of material, through the fabric at a spaced location from the rear side to the front side; the tail end of the tool still remaining at the front side, and the repeated steps of retaining the loop of material at the front side of the fabric while the tool is withdrawn from the fabric, passing the pointed end of the tool, carrying a fresh loop of material, through the previous loop, and through the fabric from the front side to the rear side, the tail end of the tool remaining at the front side; and passing the pointed end, carrying the fresh loop through the fabric at a next spaced location from the rear side to the front side, the tail end still remaining at the front side of the fabric.

The method provides a simple way of creating a decorative effect on a fabric, and when performed by the tool requires a relatively small amount of skill on the part of the user.

A further aspect of the invention is concerned with the tool itself.

According to a further aspect of the invention, an embroidery tool comprises a tubular needle portion provided at one end with a handle, and having a closed and curved point at the other end, the curvature defining opposed convex and concave surfaces, with an exit aperture provided on the convex surface adjacent the point, and a region of the surface opposite the exit aperture extending smoothly and continuously from the point to a location significantly beyond the exit aperture, the handle having an entry aperture, with smooth duct means connecting the entry aperture to the exit aperture for passage of a continuous work material, the supply of material being held outside the tool.

This construction of tool is particularly advantageous when used in the method described above, as the curve enables the end to pass easily from the front to the rear of the fabric and back again, and the location of the exit aperture on the convex surface means that the material feeds out easily from the tool.

Preferably the handle includes means for frictional engagement with the work material, to produce tension in the work material. The friction means may be provided in the duct means, in the form of a manually-operable flexible portion of the handle manipulated by the user to provide a trapping trigger. Alternatively, the friction means may be provided between the entry aperture and the supply of material, in the form of a friction aperture in the handle through which the work material passes. A slot may be provided in the handle providing access to the friction aperture. Preferably, a groove is also provided in the handle between the entry and friction apertures to accommodate the work material. The groove also assists in threading of the tool.

The needle portion may have a recess extending from the exit aperture away from the point, the recess serving to accommodate the work material passing out of the exit aperture. The recess may taper in width and depth away from the aperture.

The handle preferably has a flattened portion, to enable it to be held with comfort by the user. For ease of use the curved end is preferably set at an angle to the flattened portion, the angle depending on whether the tool is for a right or left-handed user. The needle portion may be mounted for movement between the left and right-hand positions. Further, the needle portion may be detachably mounted on the handle, to enable different sizes of needle to be used with a single handle, as well as providing for mounting in the left or right-hand positions.

The various aspects of the invention are illustrated, by way of example, in the accompanying drawings; in which.

Figure 1:
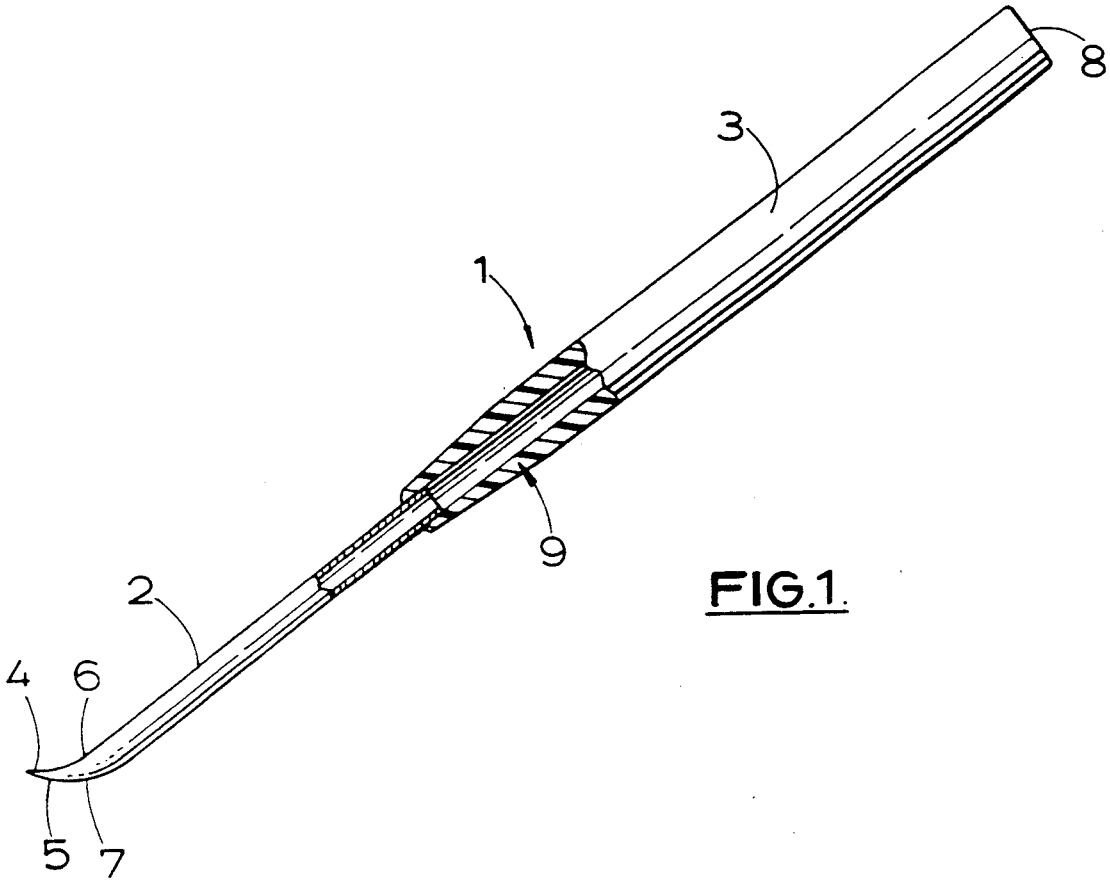
FIG. 1 is a side view, partly in section, of an embroidery tool.
Figure 2:
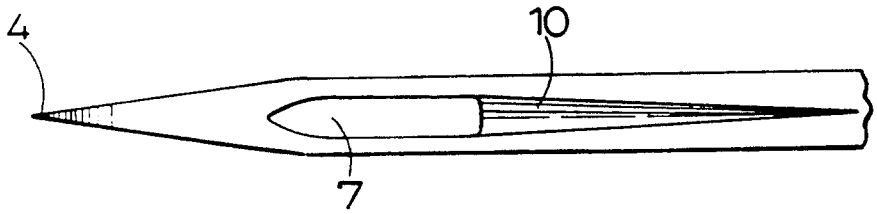
FIG. 2 is an underneath view on an enlarged scale of the needle portion of the tool of FIG. 1.

The embroidery tool 1 shown in FIGS. 1 and 2 has a tubular metal needle portion 2, to the rearward end of which is fixed a hollow plastic handle 3. The forward end of the needle portion 2 is shaped to form a closed and curved point 4, which is filled for strength. The curvature of the end defines opposed convex and concave surfaces 5, 6 respectively, and an elongate exit aperture 7 is provided adjacent the point 4 in the convex, underneath, surface 5, while the region of the surface opposite the aperture 7 and extending towards the handle 3 is smooth and continuous. The handle 3, which is also tubular, has an entry aperture 8 at its rearmost end, and a smooth straight duct 9 connecting the entry aperture 8 to the exit aperture 7. As can be seen in FIG. 2, a recess 10 extends towards the handle 3 from the rearmost end of the aperture 7, the recess 10 tapering in width and depth away from the aperture 7.

In use, a length of work material, such as a yarn, is threaded through the duct 9 from the entry aperture 8 to the exit aperture 7, with the supply of the material being held outside the tool 1. A thin wire loop (not shown) may be used to facilitate the threading operation.

Figure 3:
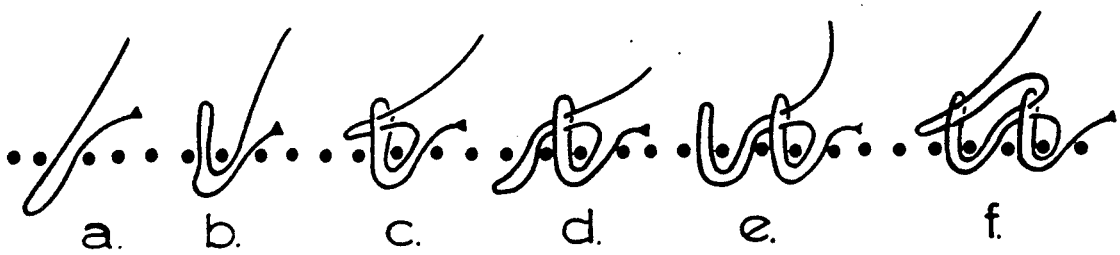
FIG. 3 is a series of sketches showing a method of embroidery.

One method of creating an embroidered decorative effect on a fabric using the tool 1 is shown in the sketches which form FIG. 3.

The handle 3 of the tool 1 is held in one of the user's hands at the front of the fabric, and the handle 3 remains at the front of the fabric throughout. The point 4 of the needle 2, carrying with it a loop or bight of yarn formed at the exit aperture 7, is pushed through the fabric from the front side to the rear side (FIG. 3*a*) and then back to the front at a spaced location (FIG. 3*b*), in this example catching one stitch of the fabric, which is knitted. The point 4 is pushed through to an extent sufficient to expose the loop of yarn on the front side, and this is held by the fingers of the user's other hand while the point is withdrawn from the fabric (FIG. 3*b*). The point 4, carrying a fresh loop of yarn, is pushed through the retained loop (FIG. 3*c*) and then through the fabric again from front to rear (FIG. 3*d*) and back to the front again at a spaced location (FIG. 3*e*). The fresh loop is then retained, and the point 4 is withdrawn from the fabric (FIG. 3*e*). The steps of FIGS. 3*c* to 3*e* are repeated to form the stitch shown in FIG. 3*f*. Any desired pattern of straight or curved lines can be created using the stitch.

The method is very easy to perform using the tool 1, as the curved nature of the point 4 enables it to pass easily through the fabric and back again to catch the stitch. The shape of the exit aperture 7 and the recess 10 are chosen to ensure that there is minimal interference with the passage of the yarn through the duct 9, and also to ensure that the yarn offers minimal resistance to the insertion of the needle portion 2 in the fabric. The elongated aperture 7 enables the yarn to pass out of the needle portion 2 in a generally forward direction; it is not required to undergo any sharp changes of direction. This is particularly important when the point 4 is retracted to leave a loop behind. When the point 4 is passed through the fabric, the portion of yarn extending from the exit aperture 7 is swept to the rear, and is partially accommodated in the recess 10, ensuring that the overall cross-section of the needle portion 2 when threaded is not greatly in excess of that of the needle portion 2 alone.

When the needle portion 2 is withdrawn from the fabric, it will sometimes be necessary to provide tension in the yarn to shorten the loop. The user may apply this tension by holding in the fingers the yarn entering the handle 3. Alternatively in a modification (not shown) the handle 3 includes means for frictional engagement with the yarn, in the form of a portion of the handle 3 which is flexible inwardly to provide a yarn trapping trigger. This would be manipulated by the user's finger pressure. In a relaxed condition, the trigger would offer no resistance to passage of yarn through the duct 9, but with finger pressure applied, the yarn would be gripped, applying the necessary tension to enable the loop to be shortened as the needle portion 2 is withdrawn.

Modifications to the method are also possible, in order to create more complex stitches to produce desired decorative effects. For example, the loop of yarn retained by the fingers after insertion and withdrawal of the needle portion 2 could be twisted before the needle portion 2 is passed through it. In another variation, a number of loops are formed in series, with the needle portion 2 then being pushed through all the loops. In yet another variation, a different length of yarn can be wound round a retained loop. (In practice, the yarn would be wound round the needle portion 2 before it is withdrawn from the fabric.) In a further variation, a fresh loop could be passed through a retained loop, but not through the fabric, to create a free chain stitch or stitches, the initial steps of the method then being performed with a subsequent loop or anchor the stitches to the fabric again. It is believed to be one of the advantages of this invention that still further variations will occur to the user once he or she is familiar with the method, and use of the tool 1.

A further advantage is that although the embroidered yarn is firmly held in the fabric, it will usually be possible to remove it without damage to the fabric by cutting the yarn. This provides the opportunity of changing the decoration on the fabric.

The use of the method and the tool 1 enables a relatively plain fabric or garment to be given a pleasing decorative effect easily and quickly. The effect may be confined to a motif, or may cover large areas of the garment. It is particularly advantageous for use on knitted garments, as plain garments are usually cheaper to purchase, and cheaper and easier to make by hand or machine, than decorated garments. The decorative effect can be varied by the choice of work material used. Subject to the size of the apertures 7, 8, and the duct 9, it will be possible to use a wide variety of yarns, threads, filaments and tapes.

However, slightly different configurations of point 4, and exit apertures 7 may be appropriate for different work materials and fabrics. Accordingly, a set of tools 1 of differing configurations may be provided. Alternatively, in a modification, the needle portion 2 is detachably mounted on the handle 3, so that different needle portions 2 can be used with a single handle 3. Further modifications, for example to the shape of the handle and the location of the entry aperture 8, as well as to the relative dimensions of the handle and needle portion could also be made as required.

Figure 4:
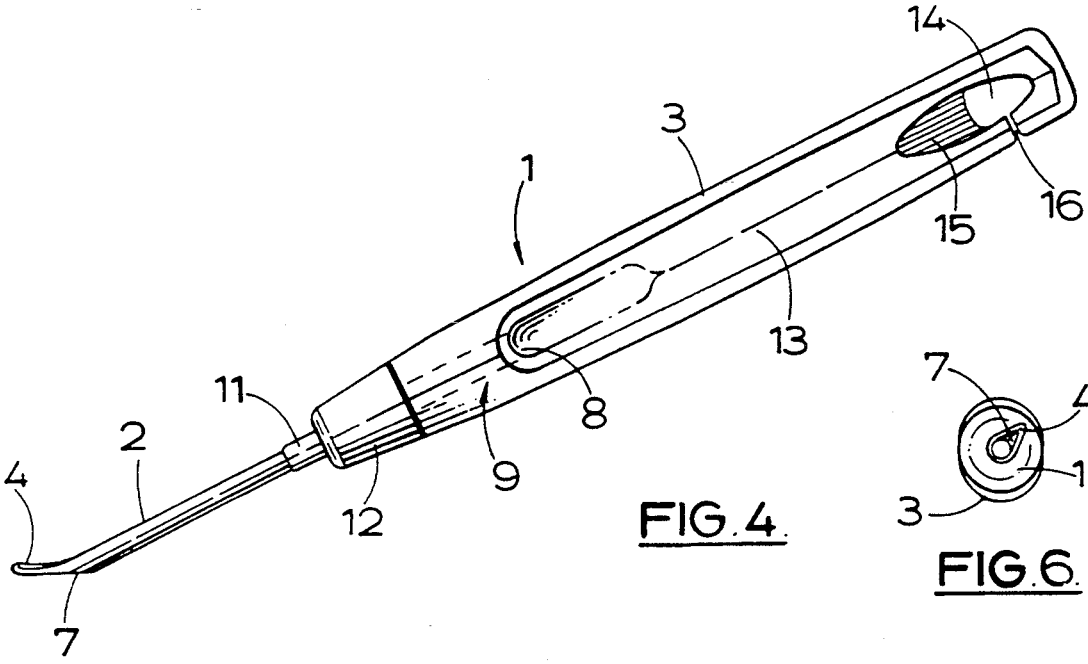
FIG. 4 is a side view of a modified embroidery tool.
Figure 6:
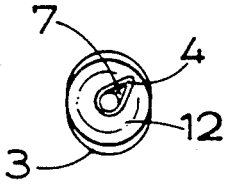
FIG. 6 is an end view of the tool of FIG. 4.
Figure 5:
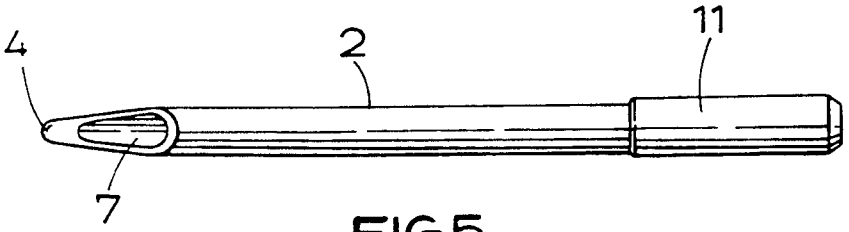
FIG. 5 is an underneath view on an enlarged scale of the needle portion of the tool of FIG. 4.

FIGS. 4 to 6 show a modified form of tool 1, and corresponding reference numerals have been applied to corresponding parts. The method of using the tool is exactly the same as that described in relation to FIG. 3.

In FIGS. 4 to 6 the tubular needle portion 2 and the handle 3 are both of plastics. The needle portion 2 again has a closed and curved point 4, although the point 4 is slightly more rounded in shape than the point 4 of the needle of FIG. 1. The elongate exit aperture 7 has a chamfered rear edge, but the recess 10 is omitted. The needle portion 2 has an enlarged rear portion 11, which is received in a mounting member 12, by means of which the needle portion 2 is attached to the handle 3. The handle 3 has the entry aperture 8 provided adjacent its forward end, so that only a small part of the handle 3 is tubular to form part of the duct 9. The remaining rearward part of the handle 3 is flattened, and has a groove 13 extending rearwardly away from the entry aperture 8. The groove 13 facilitates threading of the tool 1, and in use the yarn is accommodated in the groove 13. The rearmost end of the handle 3 has an elongate friction aperture 14, through which the yarn passes before it enters the aperture 8. Frictional engagement of the yarn in the aperture 14 provides a slight tension in the yarn, the engagement being enhanced by a ribbed recess 15 extending forwardly of the aperture 14. The yarn is inserted into the aperture 14 through a slot 16 in the handle 3. The friction aperture 14 provides a particularly convenient way of producing tension in the yarn, as it does not require any manipulation by the user.

Figure 7:
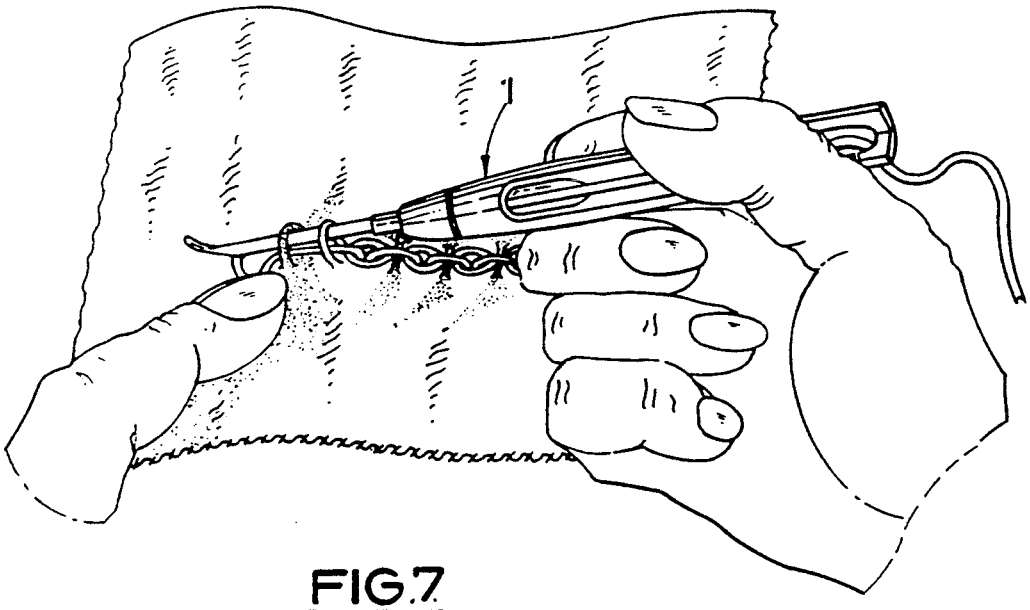
FIG. 7 shows the tool of FIG. 4 in use.

As shown in FIG. 6, the needle portion 2 is set at an angle of about 45° to the flattened part of the handle 3. This ensures that when the handle 3 is in a comfortable position for the user, the exit aperture 7 on the needle portion 2 is angled so that it is easy to retain the loop on the front side of the fabric. This can be seen in FIG. 7, which shows the tool 1 of FIG. 4 in use on a knitted fabric, and in particular how the loop is retained.

The angling of the needle portion 2 relative to the flattened part of the handle 3 means that the tool 1 is handed, that is, suitable only for left or right-handed users. In a modification (not shown), the needle portion 2 is mounted for movement between right and left-hand positions. The mounting member 12 preferably has a projection engageable in either of a pair of notches formed in the handle 3 to define the two positions. The mounting member 12 may be fixed to the handle 3, or releasably mounted by suitable means such as a snap-in engagement. Where it is releasably mounted different needle portions 2 may be used with a single handle 3.

We claim:

1. A method of decorating a knitted fabric in which yarn is threaded into the knitted fabric by performing an initial step of passing a first loop of continuous yarn through said fabric from a front side to a rear side thereof, and passing said first loop through said fabric at a spaced location from said rear side to said front side to catch a stitch of said fabric and by repeating a continuation step of passing a second loop of said continuous yarn through said first loop, passing said second loop through said fabric from said front side to said rear side thereof, and passing said second loop through said fabric at a next spaced location from said rear side to said front side thereof, repeating of said continuation step treating said second loop as said first loop.

2. A method according to claim 1, and including a step of twisting said first loop passed through said fabric from said front side to said rear side and back to said front side, before passing said second loop through said first loop.

3. A method according to claim 1, and including steps of forming a series of loops passed through said fabric from said front side to said rear side and back to said front side, and passing said second loop through all said loops in said series of loops.

4. A method according to claim 1, and including a step of winding a further length of said yarn around said first loop passed through said fabric from said front side to said rear side and back to said front side, before passing said second loop through said first loop.

5. A method according to claim 1, and including a step of passing said second loop through said first loop, but not through said fabric, and performing said initial step with a subsequent loop.

6. A method of decorating a knitted fabric in which yarn is threaded into the knitted fabric using an elongate tool, said tool having a pointed leading end provided with an aperture for threading continuous yarn, and a tail end, said method comprising performing an initial step of passing said pointed end of said tool, carrying a first loop of said yarn, through said fabric from a front side to a rear side, said tail end of said tool remaining at said front side; and passing said pointed end and carrying said first loop of said yarn, through said fabric at a spaced location from said rear side to said front side to catch a stitch of said fabric, said tail end of said tool still remaining at said front side; and repeating a continuation step of retaining said first loop of said yarn at said front side of said fabric while said tool is withdrawn from said fabric; passing said pointed end of said tool, carrying a second loop of said yarn, through said first loop, and through said fabric from said front side to said rear side, said tail end of said tool remaining at said front side; and passing said pointed end and carrying said second loop through said fabric at a next spaced location from said rear side to said front side, said tail end still remaining at said front side of said fabric, repeating said continuation step by treating said second loop as said first loop.

* * * * *

UNITED STATES PATENT AND TRADEMARK OFFICE

CERTIFICATE OF CORRECTION

PATENT NO. : 5,103,746

DATED : April 14, 1992

INVENTOR(S) : Martina Dibben; Eva-Maria King

It is certified that error appears in the above—identified patent and that said Letters Patent is hereby corrected as shown below: On the title page Item: "[76] Inventors":

delete "Robert G. Millar, "Wares Warren", Stratford Road, Wootton Wawen, Nr.Henley-in-Arden, Warwickshire, B95 6DG"

change "all of England" to

-- both of England --

"[76] Inventors" and "[21] Appl.No."

insert

-- [73] Assignee: Newey Goodman Limited, Sedgley Road West, Tipton, West Midlands, DY4 5AH, England --

Signed and Sealed this

Thirty-first Day of January, 1995

Bruce Lehman

*Attest:*

BRUCE LEHMAN

*Attesting Officer*

*Commissioner of Patents and Trademarks*